United States Patent [19]

Pedrow

[11] Patent Number: 5,033,137

[45] **Date of Patent: * Jul. 23, 1991**

[54] ORTHOPEDIC PILLOW WITH GROOVE FOR SPINE

[76] Inventor: John Pedrow, 14429 Rte. 30, North Huntingdon, Pa. 15642

[ * ] Notice: The portion of the term of this patent subsequent to May 29, 2007 has been disclaimed.

[21] Appl. No.: 529,218

[22] Filed: May 25, 1990

Related U.S. Application Data

[60] Division of Ser. No. 280,135, Dec. 5, 1988, Pat. No. 4,928,335, which is a continuation-in-part of Ser. No. 164,971, Mar. 7, 1988, Pat. No. 4,903,412, which is a division of Ser. No. 84,674, Aug. 12, 1987, Pat. No. 4,756,090.

[51] Int. Cl.[5] ..... A47G 9/00

[52] U.S. Cl. ..... 5/436; 5/431

[58] Field of Search ..... 5/434, 436, 431; 128/69, 78; D6/601

[56] References Cited

U.S. PATENT DOCUMENTS

| | | | |
|---|---|---|---|
| 2,880,428 | 4/1959 | Forsland | 5/447 |
| 4,424,599 | 1/1984 | Hannouche | 5/436 |
| 4,572,578 | 2/1986 | Perkins | 297/460 |

FOREIGN PATENT DOCUMENTS

| | | | |
|---|---|---|---|
| 2155781 | 10/1985 | United Kingdom | 297/460 |

*Primary Examiner*—Alexander Grosz

*Attorney, Agent, or Firm*—Nils H. Ljungman & Associates

[57] ABSTRACT

An orthopedic pillow having a block made of deformable material, the block having a substantially quadrilateral perimeter, an upper surface of the block having a substantially airfoil-shaped reverse curved surface, and a groove being provided in the upper surface, the groove being sized and adapted to accommodate the cervical vertebrae of a user of the orthopedic pillow. The orthopedic pillow may be provided with an arrangement for altering its temperature so as to effect either a warming or cooling of the user's cervical vertebrae. A sizing kit for determining an appropriate size of orthopedic pillow for use by a patient is also described.

2 Claims, 5 Drawing Sheets

ORTHOPEDIC PILLOW WITH GROOVE FOR SPINE

CROSS REFERENCE TO RELATED APPLICATIONS

This application is a divisional application of application Ser. No. 280,135, filed 12/5/88, now U.S. Pat. No. 4,928,335, which is a continuation-in-part of Ser. No. 164,971, filed Mar. 7, 1988, now U.S. Pat. No. 4,903,412, which is a division of Ser. No. 84,674, filed Aug. 12, 1987, now U.S. Pat. No. 4,756,090.

BACKGROUND OF THE INVENTION

1. Field of the Invention

The present invention relates to a orthopedic pillow for correctly maintaining the physiologic curvature of the cervical vertebrae of a user in a supine position.

The present invention also relates to an orthopedic pillow of the type described above, wherein such orthopedic pillow is provided with an arrangement for altering its temperature, whereby the orthopedic pillow may serve to not only correctly position the cervical vertebrae of a user, but to also effect a warming or cooling thereof.

The present invention also relates to an easily storable sizing kit for determining the proper size of such a temperature alterable orthopedic pillow appropriate for use by a particular patient.

2. Description of the Prior Art

Cervical pillows of various configurations designed with the purpose of supporting the cervical vertebrae of a user in a naturally curved and, therefore, unstressed position are known in the prior art.

U.S. Pat. No. 2,880,428 to Forsland relates to a posture pillow having an upper surface in the form of a flattened S-curve, an elevated portion of which is located beneath the user's neck, while the user's head rests on a lower portion of the pillow.

U.S. Pat. No. 4,494,261 to Morrow concerns a composite head and neck cushion for use by a person in a supine position, the cushion including a first, resilient member having an upper surface which conforms to and supports the physiologic curvature of the cervical vertebrae and a second member which supports the head in a raised but unflexed position.

U.S. Pat. No. 4,218,792 to Kogan relates to an orthopedic pillow of generally rectangular shape, the base of the rectangle adjacent the user's shoulders being formed with a concave frontal curvature, the rectangular block having a depression formed therein for the user's head and the depression being connected to the base by a recess formed in the concave frontal curvature.

Other examples of orthopedic support devices to be found in the prior art are shown in U.S. Pat. Nos. 4,320,543; 4,424,599; 4,432,107; 4,528,705; 4,550,458; 4,501,034 and 4,550,459.

All of the above-mentioned patents are hereby expressly incorporated by reference as if set forth in their entirety within the present specification.

OBJECTS OF THE INVENTION

One object of the present invention is the provision of an improved orthopedic pillow which supports the cervical vertebrae of a user in a naturally curved and, therefore, unstressed state.

Another object of the invention is the provision of such an orthopedic pillow in an efficient and simplified design which is, therefore, readily and inexpensively manufactured.

A further object of the invention is the provision of such an orthopedic pillow which also has means for altering the temperature of the pillow so as to effect a warming or cooling of the user's cervical vertebrae.

A yet further object of the present invention is the provision of a sizing kit for determining what size of such an temperature alterable orthopedic pillow is appropriate for use by a particular patient.

An even further object of the present invention is the provision of such a sizing kit which includes a multiplicity of individually sized members, the members being so configured as to be readily and easily stacked into a compact and conveniently storable package.

SUMMARY OF THE INVENTION

In one aspect, the invention features a sizing kit for determining an appropriate size of orthopedic pillow for use by a patient. The orthopedic pillow includes a block of material, a surface of the block of material being shaped to accommodate and support the cervical vertebrae of a user in a supine position. A chamber is provided in the interior of the block of material, as is a device for placing and retaining in the chamber a material the temperature of which may be altered. The sizing kit includes an ordered multiplicity of members, each of the members having a substantially similar perimeter when viewed in plan, each of the substantially similar perimeters of the multiplicity of members having at least a substantially common first characterizing dimension and a second characterizing dimension, each of the members having a shape to substantially adapt to the cervical spine of the user, each of the ordered multiplicity of members, other than a first member of the ordered multiplicity, having a lower surface which substantially corresponds to the shape of the preceding member in which the ordered multiplicity, whereby the ordered multiplicity of members may be stacked one upon the other according to order to produce a compact and therefore readily storable package. Interconnecting means are provided for interconnecting the ordered multiplicity of members when the members are stacked one upon the other to form the readily storable package, as is a hanging means for handing the readily storable package.

In another aspect of the invention, the invention features an orthopedic pillow which includes a block of a deformable material, the block having a substantially airfoil-shaped reverse curved surface when the block is viewed in elevation, and a groove provided in the upper surface, the groove being sized and adapted to accommodate the cervical vertebrae of a user of the orthopedic pillow.

In yet another aspect, the invention features a cervical orthopedic pillow, the cervical orthopedic pillow including a block of deformable material, a surface of the block of material being shaped to accommodate and support the cervical vertebrae of a user in a supine position, a chamber provided in the interior of the block of material, and a device for placing and retaining in the chamber a material the temperature of which may be altered.

These and other features of the present invention will now be described by way of a number of preferred embodiments, after first briefly describing the accompanying drawings, wherein:

DESCRIPTION OF THE PREFERRED EMBODIMENTS

Figure 1:
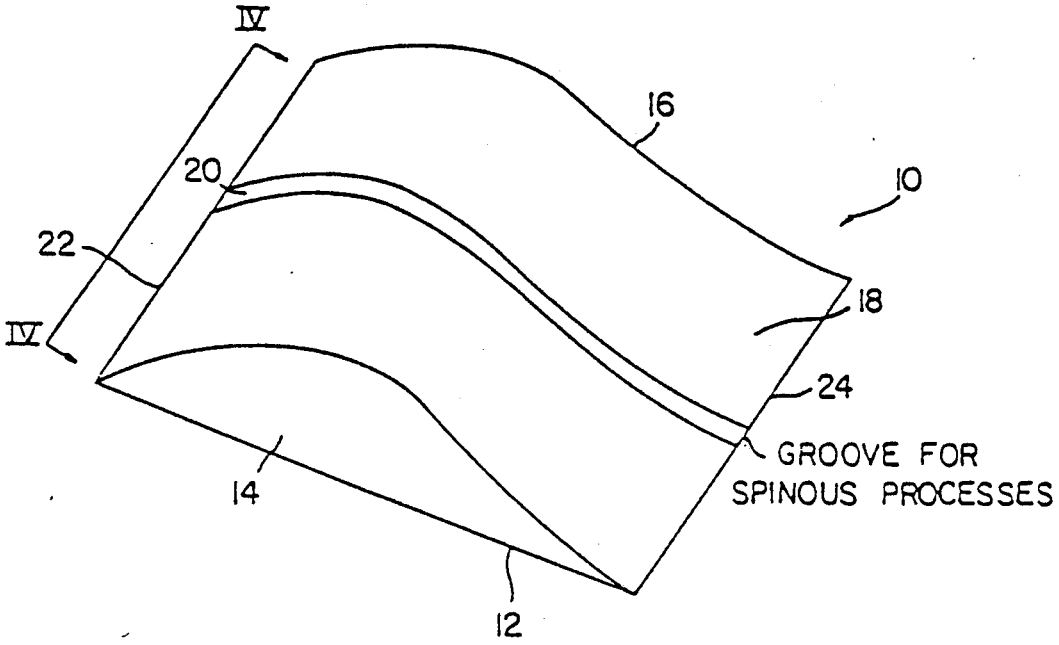
FIG. 1 is an isometric view of an orthopedic pillow constructed according to the present invention.

Referring first to FIGS. 1–4, an orthopedic pillow 10 is formed from a block of a deformable material which has a generally quadrilateral perimeter when viewed in plan. The block of deformable material is bounded by a lower surface 12, an upper surface 18 and side walls 14 and 16. For ease of construction, lower surface 12 and side walls 14 and 16 are generally substantially planar surfaces. However, the particular configuration of these surfaces is not an essential aspect of the invention, and the present invention is contemplated as encompassing orthopedic pillows having non-planar lower and side surfaces. Aspects of the pillows in the patents incorporated herein by reference may be used instead of the ones shown in the figures described above.

The upper surface 18 of the block of deformable material which makes up orthopedic pillow 10 is formed so as to have a substantially airfoil-shaped and reverse curved configuration and includes a recessed groove 20 located approximately medially between side walls 14 and 16 and extending from an upper edge 22 to a lower edge 24 of orthopedic pillow 10.

Figure 2:
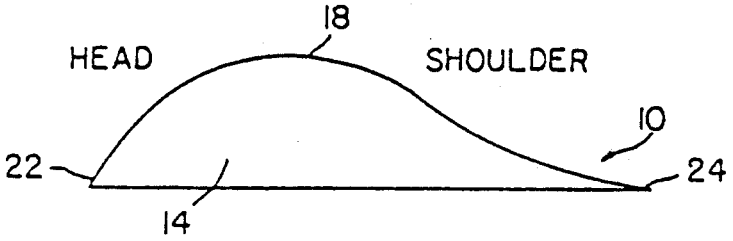
FIG. 2 is an elevational side view of the orthopedic pillow of FIG. 1.
Figure 3:
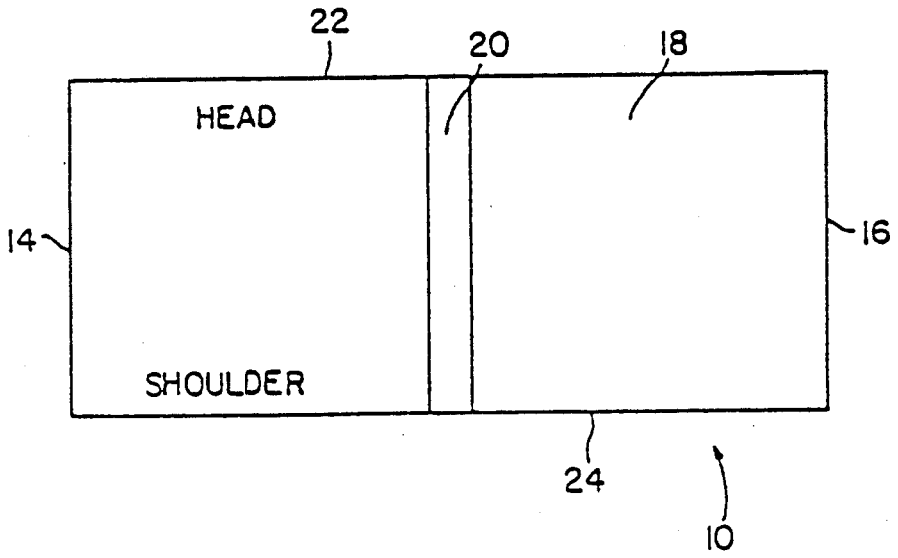
FIG. 3 is a top plan view of the orthopedic pillow of FIG. 1.
Figure 4:
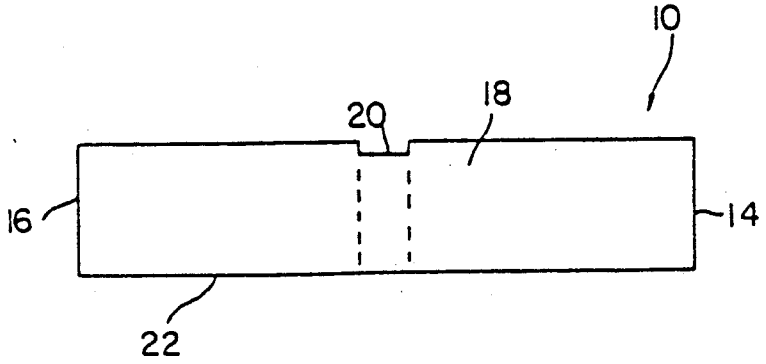
FIG. 4 is an elevational edge view taken along the lines IV—IV of the orthopedic pillow shown in FIG. 1.

The orthopedic pillow which is the subject of the present invention is so configured that, referring most particularly now to FIG. 2, when the user is in a supine position with his head proximate the upper edge 22 and with his shoulders located overlying or slightly above lower edge 24, the user's cervical vertebrae will be maintained in a posterior facing arch, which is the natural or unflexed state of the cervical vertebrae. Additionally, recessed groove 20 is dimensioned and adapted to accommodate the cervical vertebrae of the user and thus prevent or reduce any undue pressure which might be otherwise exerted.

Figure 5:
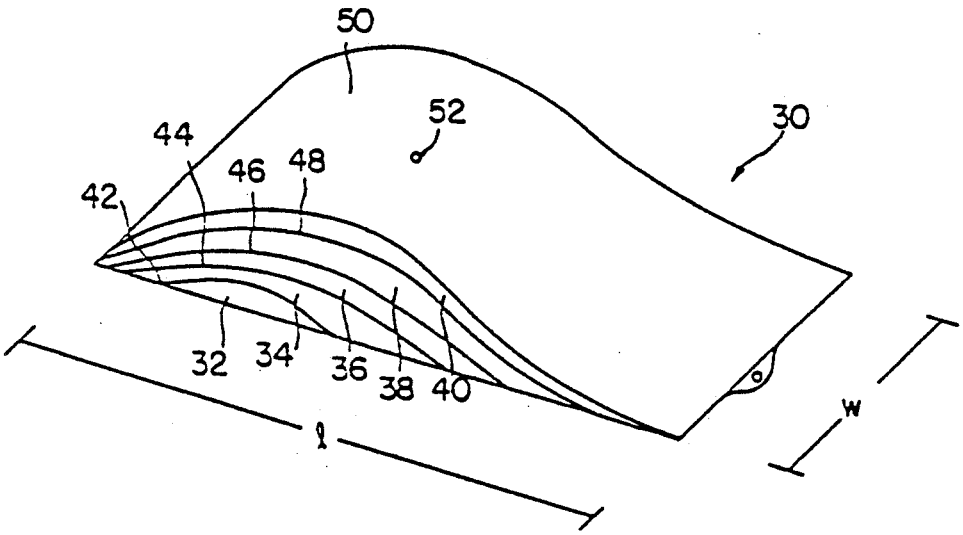
FIG. 5 is an isometric view of an orthopedic pillow sizing kit constructed according to the present invention.
Figure 6:
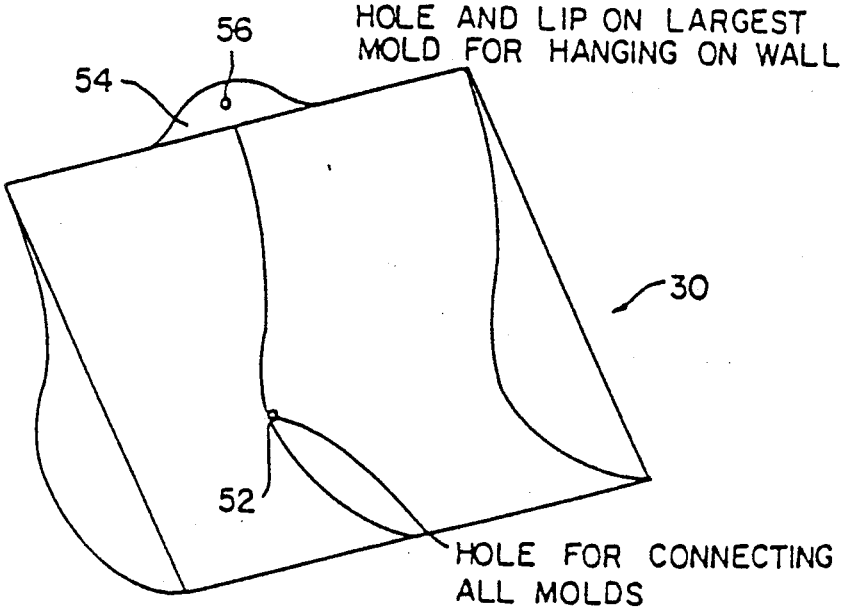
FIG. 6 is yet another isometric view of the orthopedic pillow sizing kit shown in FIG. 5.

Referring now to FIGS. 5 and 6, a sizing kit 30 for determining the appropriate size of orthopedic pillow 10 for use by a patient generally includes an ordered multiplicity of individual members 32–40 each of said individual members 32–40 having a common width w. The lengths 1 of said members 32–40 increases with respect to their order within the set of members, with the length 1 of member 32 being the least and the length 1 of member 40 being the greatest.

Additionally, each of the upper surfaces 42–50 of each of members 32–40, respectively, is generally configured as an airfoil-shaped and reverse curved surface. Moreover, the lower surfaces of each of members 34–40 is also a generally airfoil-shaped reverse curved surface which substantially corresponds to the airfoil-shaped reverse curved surface of the preceding member in the ordered multiplicity of members 32–40. For ease of fabrication, the lower surface of the first member 32 is generally planar. However, sizing kits having a first member with a nonplanar lower surface are contemplated as being within the scope of the present invention.

As a result of the above detailed construction of sizing kit 30, individual ordered members 32–40 may be stacked one upon the other, as shown in FIG. 5, so as to produce a compact and, therefore, readily storable package.

Each of said individual members 32–40 is preferably provided with a throughgoing hole 52, by means of which all of the individual members 32–40 may be interconnected, by means well known in the art, so as to retain the members 32–40 in a stacked, compact and, therefore, readily storable package.

Finally, at least the largest member 40 is provided with a projecting tab portion 54 having a throughgoing hole 56 to enable the assembled sizing kit 30 to be hung on a wall or the like.

The sizing kit 30 of the present invention provides a convenient and compact means for determining the appropriate size of an orthopedic pillow 10 which is appropriate for use by a particular patient. The sizing kit 30 may be disassembled into its individual members for comparison with the particular patient's physique and may be thereafter reassembled and conveniently stored. Aspects of the pillows in the patents incorporated herein by reference may be used instead of the ones shown in the figures described above.

We turn now to FIGS. 7–11, showing alternative embodiments of an orthopedic pillow such as is described above, wherein such orthopedic pillow is additionally provided with an arrangement whereby its temperature may be significantly altered such that the orthopedic pillow will not only support the cervical vertebrae of a user in an unstressed state but may also serve to effect a warming or cooling thereof.

Figure 7:
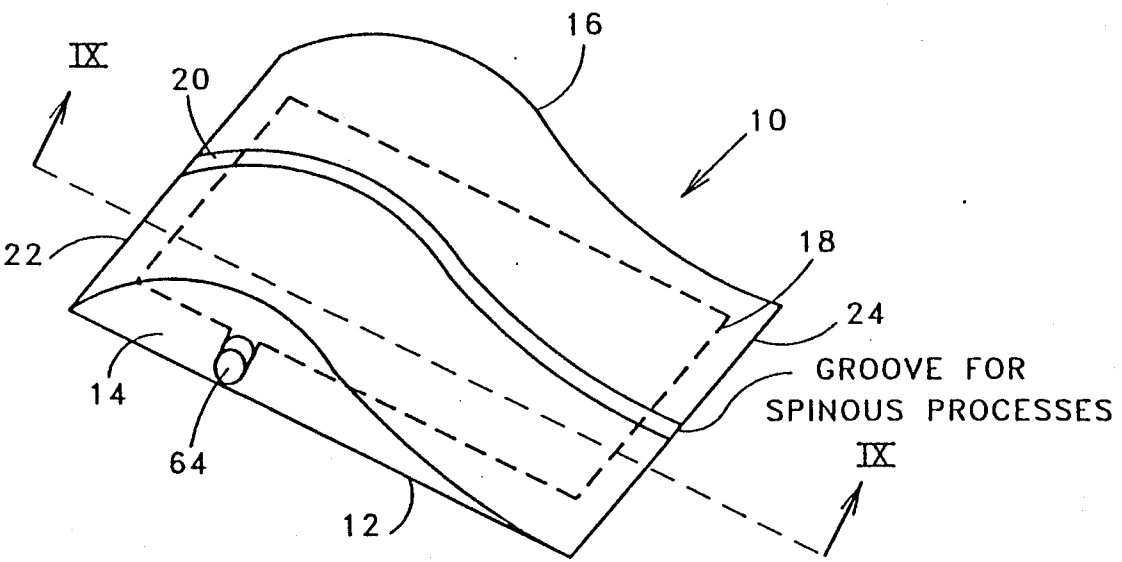
FIG. 7 is an isometric view of an alternative embodiment of an orthopedic pillow which includes an arrangement for altering the temperature of the orthopedic pillow.
Figure 9:
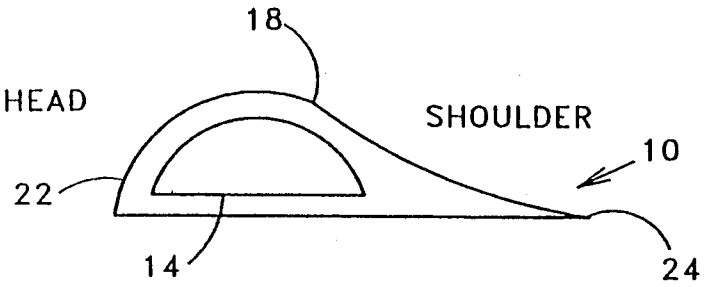
FIG. 9 is a cross-sectional view along the lines IX—IX indicated in FIG. 7.
Figure 8:
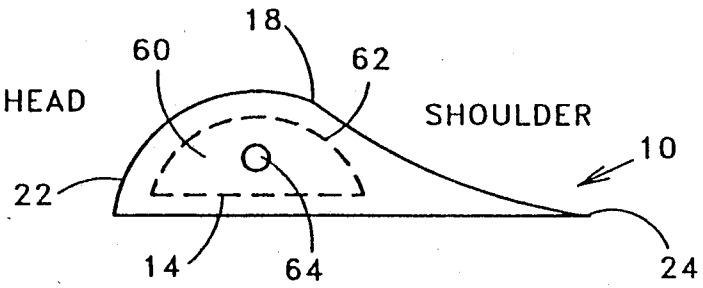
FIG. 8 is an elevational side view of the orthopedic pillow of FIG. 7.

Referring first to FIGS. 7, 8 and 9, showing a first alternative embodiment of a temperature alterable orthopedic pillow, orthopedic pillow 10 is constructed and configured substantially as described above, with the exception that it is also provided with the additional feature of an internal bladder 60 which is preferably configured, as shown most clearly in FIG. 7, so as to extend over major portions of the length and width of orthopedic pillow 10. Additionally, as shown most clearly in FIGS. 8 and 9, bladder 60 is preferably contoured and dimensioned so as to roughly follow the contours of the upper and lower surfaces of orthopedic pillow 10. In the configuration thus shown and described, the maJor interior portion of orthopedic pillow 10 is occupied by bladder 60 (e.g., such as a bladder similar to one in a hot water bottle or an ice pack) which is encased within an outer shell of deformable material.

Preferably, the outer surfaces of bladder 60 are lined with an impermeable material 62, e.g., a plastic film. Additionally, bladder 60 is preferably provided with an externally accessible filler cap 64 (e.g., such as one for a hot water bottle or an ice pack) through which bladder 60 may be filled with a liquid (for example, water) which is either relatively warmer or cooler as compared to the ambient surroundings.

However, the provision of filler cap 64 is not deemed essential, inasmuch as it is contemplated that bladder 60 could be filled with a permanent fluid and that the entire orthopedic pillow 10 could be either heated or cooled prior to use.

Figure 10:
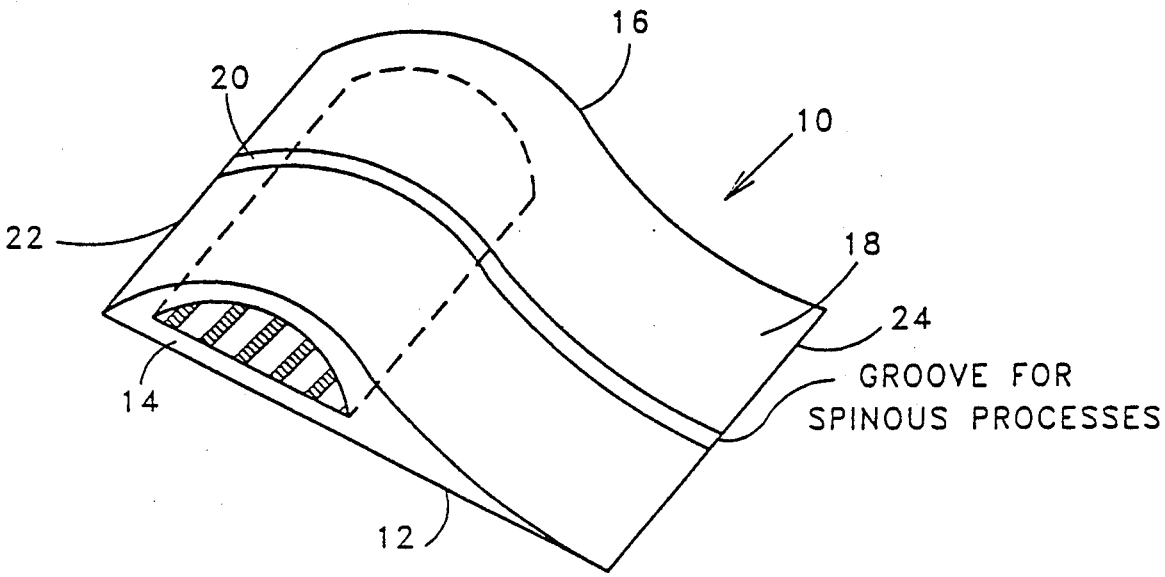
FIG. 10 is an isometric view of another alternative embodiment of an orthopedic pillow which includes an arrangement for altering the temperature thereof.
Figure 11:
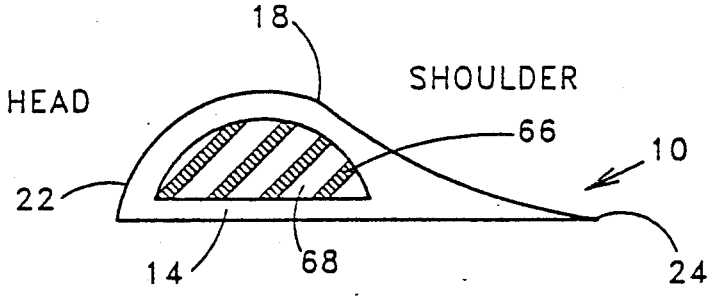
FIG. 11 is an elevational side view of the orthopedic pillow of FIG. 10.

Referring now to FIGS. 10 and 11, showing a second alternative embodiment of a temperature variable orthopedic pillow, orthopedic pillow 10, once again preferable formed of a deformable material is provided with an internal chamber (or cavity) 66. Preferably, cavity 66 extends over major portions of the length and width of orthopedic pillow 10, and is dimensioned and contoured such that its upper and lower surfaces roughly correspond to the upper and lower surfaces of orthopedic pillow 10. Chamber 66 intersects one of the exterior surfaces of orthopedic pillow 10 (preferably, as shown, a side surface thereof), and is thereby externally accessible.

A temperature maintaining element 68 is also provided in this embodiment. Preferably, the exterior contours of temperature maintaining element 68 substantially correspond to the interior contours and dimensionings of chambers 66.

In this embodiment, temperature maintaining element 68 is preferably the type of fluid or gel filled pouch which may be either heated or cooled, and which will then retain its temperature altered state for a relatively lengthy period of time. For example, one form of such a temperature maintaining element 68 is commonly referred to as a "hydrocollator".

A chemical or electrical heating or cooling apparatus 68 is also contemplated as being within the scope of the present invention.

Once temperature maintaining element 68 has been either heated or cooled (e.g., through the use of heated water, a microwave oven or by refrigeration), it may then be inserted into chamber 66 so as to maintain orthopedic pillow 10 in a temperature altered state for a relatively lengthy period of time.

While the invention has been described by way of a particular preferred embodiment, it will be understood by those skilled in the art that various substitutions of equivalents can be made without departing from the spirit and scope of the invention as set forth in the following claims:

What is claimed is:

1. A cervical orthopedic pillow, said cervical orthopedic pillow comprising:

a block of deformable material;

a surface of said block of material being shaped to accommodate and support the neck and the cervical vertebrae of a user in a supine position;

said surface which is shaped to accommodate and support the neck and the cervical vertebrae of a user in a supine position having a substantially airfoil-shaped reverse curved surface when said block of material is viewed in elevation; and a groove formed in said surface which is shaped for accommodating and partially surrounding the cervical vertebrae;

said groove running from one end of said pillow to the opposite end of said pillow.

2. A cervical orthopedic pillow according to claim 1, wherein said pillow has a rectangular shape.

* * * * *